US005113930A

United States Patent [19]

le Gauyer

[11] Patent Number: 5,113,930

[45] Date of Patent: May 19, 1992

[54] HEAT EXCHANGER APPARATUS FOR A MOTOR VEHICLE, HAVING A MAIN HEAT EXCHANGER COMPRISING A WATER BOX CONTAINING A SECONDARY HEAT EXCHANGER

[75] Inventor: Philippe le Gauyer, Paris, France

[73] Assignee: Valeo Thermique Moteur, Le Mesnil-Saint-Denis, France

[21] Appl. No.: 738,674

[22] Filed: Jul. 31, 1991

[30] Foreign Application Priority Data

Jul. 31, 1990 [FR] France ..... 90 09766

[51] Int. Cl.[5] ..... F28F 9/00

[52] U.S. Cl. ..... 165/78; 165/140; 165/157; 165/916

[58] Field of Search ..... 165/78, 140, 157, 916

[56] References Cited

U.S. PATENT DOCUMENTS

| | | | |
|---|---|---|---|
| 1,938,589 | 12/1933 | Hansen | 165/157 |
| 2,779,573 | 1/1957 | Kuroda | 165/157 X |
| 4,227,570 | 10/1980 | Crews | 165/67 |
| 4,432,307 | 2/1984 | Godin | 122/14 |
| 4,548,260 | 10/1985 | Stachura | 165/78 |
| 4,553,586 | 11/1985 | Lardner | 165/76 |

FOREIGN PATENT DOCUMENTS

| | | | |
|---|---|---|---|
| 0196257 | 1/1986 | European Pat. Off. . | |
| 3341263 | 5/1985 | Fed. Rep. of Germany | 165/916 |
| 2549593 | 1/1985 | France . | |

*Primary Examiner*—Allen J. Flanigan
*Attorney, Agent, or Firm*—Longacre & White

[57] ABSTRACT

Heat exchanger apparatus for a motor vehicle engine comprises a main heat exchanger having a water box containing a secondary heat exchanger that includes two coupling tubes, which extend sealingly through a side wall of the water box. The secondary heat exchanger is secured in the latter by means of these tubes, each fitted to the secondary heat exchanger by being introduced successively through an access orifice formed in the water box side wall and then into a seating formed in the secondary heat exchanger. The water box side wall carries at least one slide inside the water box, and the secondary heat exchanger has at least one sliding element which slides in the slide so as to enable the secondary heat exchanger to be precisely positioned within the water box, so that the two coupling tubes can then be fitted.

9 Claims, 2 Drawing Sheets

HEAT EXCHANGER APPARATUS FOR A MOTOR VEHICLE, HAVING A MAIN HEAT EXCHANGER COMPRISING A WATER BOX CONTAINING A SECONDARY HEAT EXCHANGER

FIELD OF THE INVENTION

This invention relates to heat exchanger apparatus, in particular (though not exclusively) for use in a motor vehicle, of the kind comprising a main heat exchanger having a water box with a secondary heat exchanger contained in the water box.

BACKGROUND OF THE INVENTION

In known apparatuses of this kind, a first fluid flows through the main heat exchanger, while a second fluid, which is cooled by the first fluid, flows through the secondary heat exchanger. In the application of such an apparatus to motor vehicles, the first fluid is the cooling liquid for the engine of the vehicle, while the second fluid may for example be lubricating oil for the engine, or gearbox oil, or oil for a torque converter. Thus the engine coolant liquid not only fulfils its usual function of cooling the engine, but also an additional function whereby it cools a further fluid related to the operation of the vehicle.

In known arrangements of this kind, the secondary heat exchanger is introduced through an open side of the water box, and the latter is then secured to the body or the tube bundle of the main heat exchanger. The secondary heat exchanger has two coupling tubes, which serve respectively as input and output tubes for the second fluid, and which extend sealingly through two orifices formed in a wall of the water box. This arrangement also secures and retains the secondary heat exchanger within the water box.

In the specification of French patent application No. 83 12200, published under the number FR-2 549 593-A, there is disclosed an apparatus of the kind described above, in which the two coupling tubes are fitted on to the secondary heat exchanger after the latter has been itself fitted within the water box of the main heat exchanger. Each of the two coupling tubes is then introduced from outside the water box, first through a respective one of the orifices mentioned above and formed in the wall of the water box, and then into an appropriate seating which is part of the second heat exchanger. An advantage of that arrangement is that it enables the external dimensions of the secondary heat exchanger to be made substantially the same as the internal dimensions of the water box; and this in turn enables the efficiency of the secondary heat exchanger to be improved while still using a water box of standard dimensions.

However, such an arrangement has the disadvantage that the secondary heat exchanger must be positioned in an extremely accurate manner within the water box, so that the two orifices in the wall of the latter can be strictly aligned with the two seatings of the secondary heat exchanger to enable the two coupling tubes to be subsequently fitted. This relative positioning must be effected before, and maintained throughout, the operation of fitting the two coupling tubes.

DISCUSSION OF THE INVENTION

A main object of the present invention is to overcome this drawback.

To this end, the invention is directed to a water box for a main heat exchanger, in particular for a motor vehicle, in which the water box contains a secondary heat exchanger having two coupling tubes which extend sealingly through a wall of the water box, and through which the secondary heat exchanger is secured in the water box, with each of the coupling tubes being fitted on the secondary heat exchanger by being introduced successively into an access orifice formed in a wall of the water box and into a seating for reception of the corresponding coupling tube, the seating being formed in the secondary heat exchanger.

According to an essential feature of the invention, the said water box wall is provided, within the water box and in the region of the two said access orifices, with at least one slide which is adapted to receive a sliding element forming part of the secondary heat exchanger, and which is further adapted to enable the secondary heat exchanger to be moved in straight-line translational movement along the wall of the water box up to an abutment position in which each of the two access orifices of the said wall is aligned with the corresponding one of the two said seatings.

This arrangement ensures that the secondary heat exchanger is positioned in a precise manner within the water box, so as to enable the two coupling tubes to be then fitted.

In one preferred form of the invention, the water box comprises two said slides, adapted to receive two respective sliding members which are fixed with respect to the secondary heat exchanger. Preferably, each of these two slides comprises a collar which is coaxial with the corresponding one of the two said seatings in the secondary heat exchanger.

According to another feature of the invention, each of the said collars has two opposed annular faces, one of which is adapted to come into abutting engagement against the wall of the water box, while the other is adapted to come into abutting engagement against a wall of the slide, which is separated from the wall of the water box by a distance slightly greater than the thickness of the collar.

According to a further feature of the invention, the collar is attached to the body of the secondary heat exchanger through a cylindrical portion having a diameter which is smaller than that of the collar, while the wall of the slide has a slot which is delimited by two parallel edges facing each other and defining the direction of the straight line translational movement of the secondary heat exchanger, the two said side walls of the slot being separated from each other by a distance which is substantially equal to the external diameter of the said cylindrical portion, and the slot being open at one end so as to enable the collar to be introduced into it, and closed at its other end to define an abutment. This abutment is preferably defined by a semi-circular edge of the slot which joins together the two parallel side edges of the latter, with the radius of the semi-circular edge being substantially equal to the radius of the said cylindrical portion, and struck from a centre aligned with the centre of a said access orifice.

Thus, when the secondary heat exchanger is in abutment against the two slides, the two access orifices in the side wall of the water box are exactly aligned with the two seatings formed in the secondary heat exchanger. It is then only necessary to fit the two coupling tubes by simple insertion, after which they are secured to the secondary heat exchanger by any appropriate means, for example by a screwed coupling or by a suitable upsetting or riveting operation.

A preferred embodiment of the invention will now be described and compared with an example of an arrangement according to the prior art, by way of example only and with reference to the accompanying drawings.

DESCRIPTION OF A PREFERRED EMBODIMENT OF THE INVENTION

Figure 1:
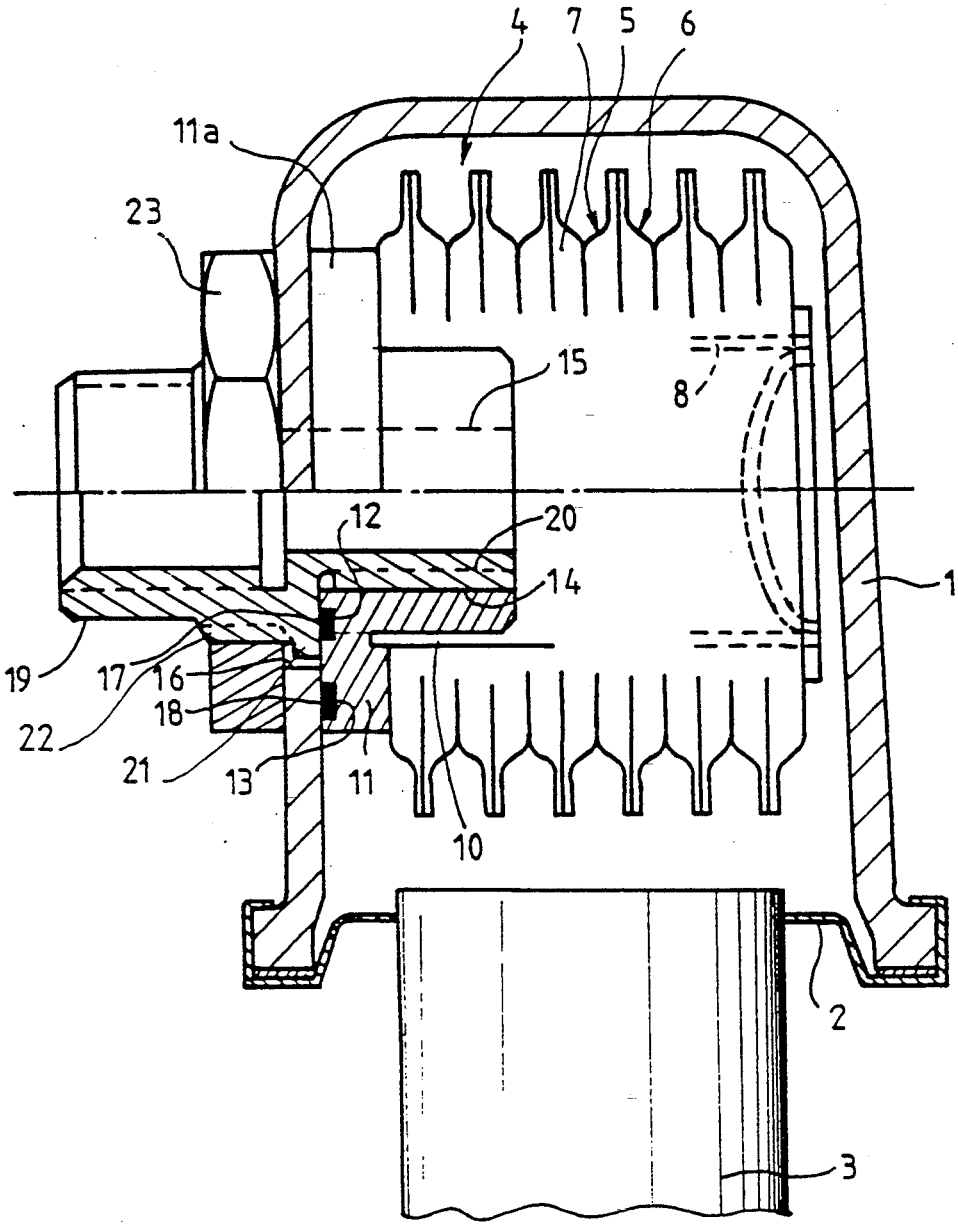
FIG. 1 is an elevation, seen in half section, of a water box of a main heat exchanger containing a secondary heat exchanger, in accordance with the prior art.

Reference will first be made to FIG. 1, which shows a known type of arrangement as disclosed in the specification of French patent application No. 83 12200 mentioned above. In FIG. 1, a main heat exchanger has a water box 1, and may for example be a cooling radiator for cooling the liquid coolant of a heat engine. The water box 1 is arranged to be assembled with a collector plate 2 which contains the open ends of a plurality of flow tubes 3, the plate 2 and tubes 3 being part of the main heat exchanger.

A secondary heat exchanger, indicated generally by the reference numeral 4, is arranged inside the water box 1. The secondary heat exchanger 4 is arranged for cooling a different fluid from that which flows through the flow tubes 3, the fluid to be cooled in the secondary heat exchanger 4 being for example the gearbox oil. In this example, the secondary heat exchanger 4 comprises a stack of half plates 5 and 6, which are brazed together and which define at their ends elementary collecting chambers 7, which communicate with each other and with a distributor tube 8 which also acts as a longitudinal stretcher member. The free end of the distributor tube 8 is fitted within a coaxial groove 10 formed in an abutment plate 11, and is brazed into this tube 10. The abutment plate 11 also has two further coaxial grooves 12 and 13.

The secondary heat exchanger 4 also has a further abutment plate 11*a*. The abutment plates 11 and 11*a* have threaded bores 14 which are coaxial with the geometric axes 15 of holes 16 that are formed in one of the side walls of the water box 1. The grooves 12 and 13 are adapted to contain annular sealing rings 17 and 18.

For securing the secondary heat exchanger 4 to the water box 1, coupling tubes 19 are provided. Each coupling tube 19 has a threaded portion 20 which is screwed into the threaded bore 14 of the corresponding abutment plate 11. Each coupling tube 11 also includes a crown portion 21 which bears against the seal 12 of the corresponding abutment plate in order to provide the necessary sealing effect. Beyond the crown portion 21 the coupling tube 19 has a second threaded portion 22, on to which a nut 23 is screwed. The nut 23 bears against the outer wall of the water box 1, so as to compress the seal 18 against the inner wall of the water box and thus provide sealing at this interface.

Thus, in this prior art arrangement, the secondary heat exchanger 4 is first placed inside the water box 1, in such a way that the threaded bores 14 of the abutment plates are aligned with the holes 16 in the water box 1. The two coupling tubes 13 are then threaded, by means of their threaded portions 20, into the threaded bores 14. The nuts 23 are then screwed on to the threaded portions 22.

As indicated above, however, this known arrangement has disadvantages, in the sense that exact positioning of the secondary heat exchanger 4 within the water box 1 is difficult to achieve, in spite of the fact that the outer dimensions of the secondary heat exchanger 4 are very close to the internal dimensions of the water box 1.

Figure 2:
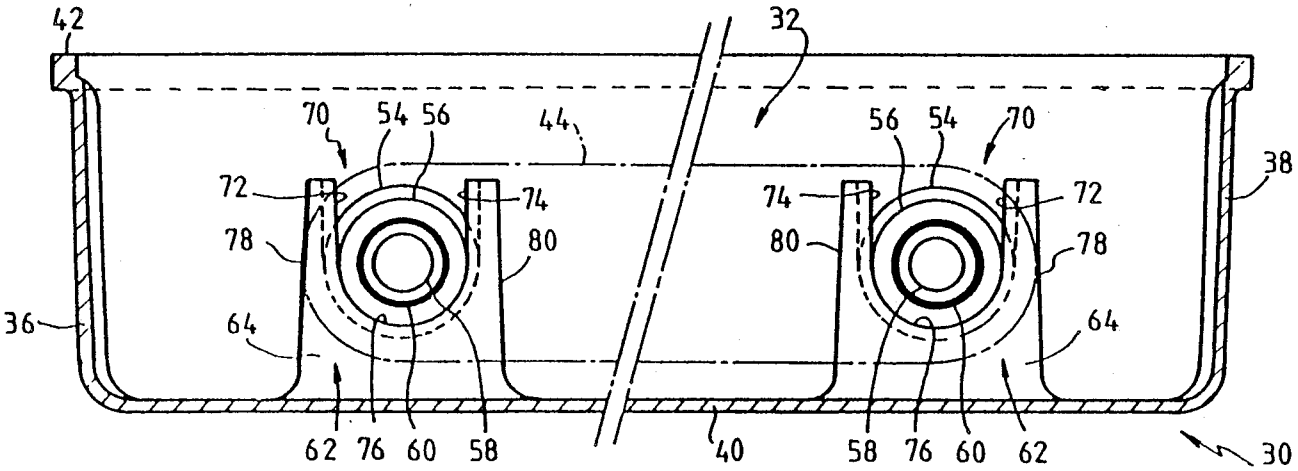
FIG. 2 is a plan view, seen through its open side, of a water box of a main heat exchanger containing a secondary heat exchanger in accordance with the present invention.
Figure 3:
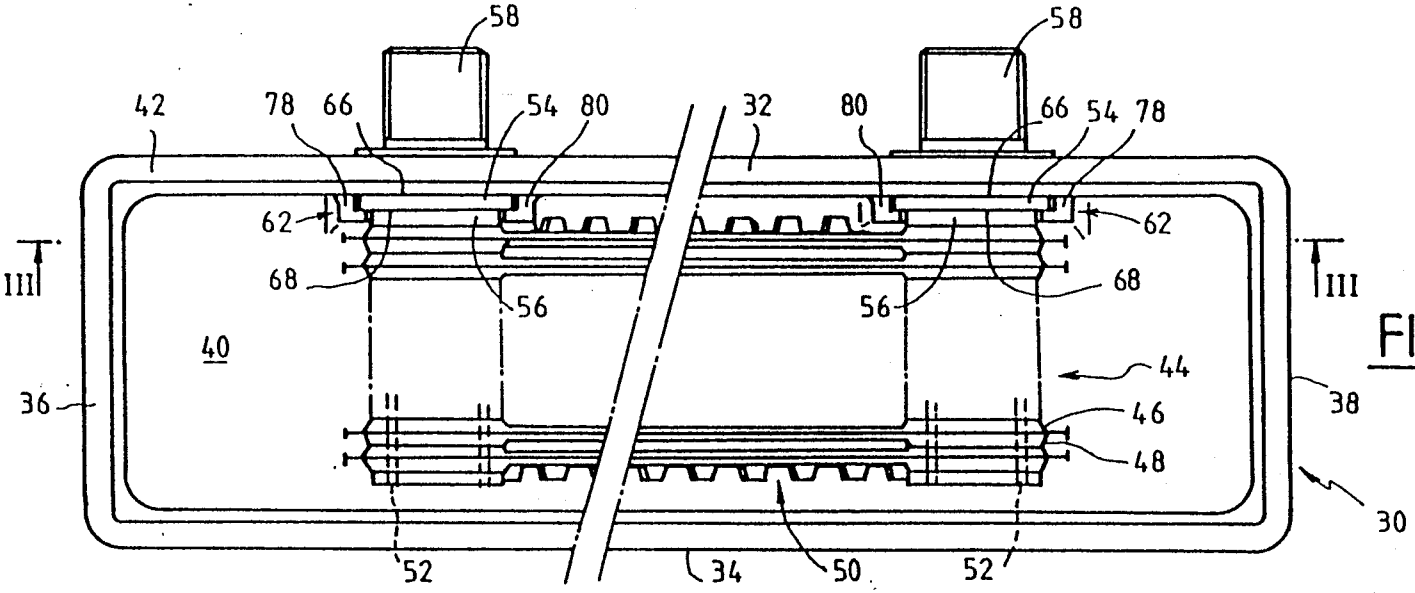
FIG. 3 is a view in cross section taken on the line III—III in FIG. 2.

Reference is now made to FIGS. 2 and 3, which show the preferred arrangement in accordance with the present invention. In these Figures, a main heat exchanger has a water box 30, and may for example consist of a cooling radiator for a heat engine. The water box 30 has two opposed side walls 32 and 34, together with two further opposed side walls 36 and 38. The side walls are joined together through a base wall 40. The four side walls 32, 34, 36 and 38 together define an open side or face of the water box 30, which is bounded by an edge 42 having a rectangular shape and which serves in the usual way for assembly of the water box 30 on to a collector which is not shown.

A secondary heat exchanger, generally indicated by the reference numeral 44, is arranged within the water box 30. The secondary heat exchanger 44 is arranged to cool a fluid different from that which flows in the water box 30, and which may again be the gearbox oil.

The secondary heat exchanger 44 in this example comprises a stack of half plates 46 and 48, which together constitute the body 50 of the heat exchanger 44. The latter also includes two distributor tubes 52, which act as stretchers. The free ends of the distributor tubes 52 are joined to two collars 54 in the form of rings which are coaxial with the two distributor tubes 52. Each of the collars 54 is joined to the body 50 of the heat exchanger through a cylindrical portion 56, again in the form of a ring but having a diameter smaller than the collar 54. Each tube 52, in combination with the associated collar 54 and cylindrical portion 56, defines an internal seating (not shown) for receiving a coupling tube 58 when the latter is inserted from outside. In operation, one of these coupling tubes 58 serves for entry of the fluid flowing in the secondary heat exchanger 44, while the other serves as an exit for the same fluid. During assembly, each of the coupling tubes 58 is first introduced through an access orifice 60 formed in the side wall 32 of the water box 30, and is then fitted in the corresponding seating mentioned above.

The side wall 32 is formed, within the water box 30, with two slides 62 which are arranged respectively in the region of the two access orifices 60. The two slides 62 are arranged to receive the respective collars 54, which, with the adjacent cylindrical portions 56, act as sliding elements for enabling the secondary heat exchanger 44 to be moved in translational movement along the side wall 32 of the main heat exchanger, to an abutment position in which the two access orifices 60 are respectively aligned with the two seatings mentioned above of the secondary heat exchanger 44.

Each slide 62 comprises a generally rectangular wall 64 which extends parallel to the side wall 32 of the water box 30, and which is separated from the latter by a distance which is slightly greater than the thickness of the collar 54 (FIG. 2). Each collar 54 has two opposed annular faces, namely a first face 66 which is arranged to come into abutment against the internal surface of the side wall 32 of the water box 30, and a second face 68 which is arranged to come into abutment against the inner surface of the wall 64 of the appropriate slide 62.

A slot 70 is formed in each slide wall 64, and is bounded by two substantially parallel side edges 72 and 74, arranged facing each other and defining the direction of the translational movement of the appropriate sliding element 54, 56. The edges 72 and 74 of each slot are separated by a distance that is substantially equal to the outer diameter of the cylindrical portion 56, for guiding the latter in the direction of the translational movement. The edges 72 and 74 are joined together through a semi-circular edge 76, the radius of which is substantially equal to the radius of the cylindrical portion 56. The centre of the semi-circular edge 76, from which its radius is struck, is aligned with the centre of the access orifice 60 associated with it.

Each slot 70 thus has an open end which is directed towards the open side of the water box 30, and a closed end which is directed towards the base wall 40 of the water box. This closed end of the slot, defined by the semi-circular edge 76, constitutes an abutment when the corresponding cylindrical portion 56 has been introduced.

The wall 64 of each slide 62 is joined to the side wall 32 of the water box 30 through two parallel connecting edges 78 and 80, which are separated from each other by a distance which is sufficient to allow the collar 54 to pass, so that, as already mentioned, the latter acts as a sliding element arranged to slide in the slide 62 itself. In addition, the slide wall 64 is joined directly to the base wall 40 of the water box 30. The latter is preferably made of a plastics material, with both slides 62 being preferably formed integrally with it.

In order to fit the secondary heat exchanger 44 inside the water box 30, the two collars 54 are merely offered up in line with the free ends of the slides 62, with the annular faces 66 of the two collars 54 being placed against the internal face of the side wall 32. The secondary heat exchanger 44 is then moved in a straight line parallel to the side wall 32, so that each of the cylindrical portions 56 comes into abutment against the semi-circular edge 76 of the corresponding slide. In this abutment position, the two seatings in which the secondary heat exchanger 44 is received are aligned respectively with the access orifices 60 of the water box 30. The two coupling tubes 58 are then fitted simply by introducing each of them straight through the respective access orifice 60 and into the corresponding seating of the secondary heat exchanger 44. The two coupling tubes 58 can be secured to the secondary heat exchanger 44 in any suitable way, for example by means of a threaded engagement in the manner described in the specification of French patent application No. 83 12200 already mentioned.

Although the invention has been described with particular reference to a water box having two slides arranged to receive two sliding elements, it is possible to design a water box, within the scope of the invention, having only a single slide for receiving only a single sliding element which is carried by the body of the secondary heat exchanger.

The secondary heat exchanger, contained within the water box, is not necessarily a heat exchanger of the plate type as described. It could for example instead comprise a heat exchanger of some other type, for instance the type having a multiplicity of heat exchanger tubes.

What is claimed is:

1. Heat exchanger apparatus comprising a main heat exchanger having a water box and a secondary heat exchanger in the water box, the water box having a side wall defining two access orifices therein, and the secondary heat exchanger having two coupling tubes and means defining a seating for receiving each said coupling tube, with each said coupling tube having been fitted thereto by being introduced into the corresponding access orifice and then into the corresponding seating, the apparatus further comprising at least one slide carried by the said side wall of the water box and arranged in the interior of the water box in the region of the two access orifices, the secondary heat exchanger further comprising a sliding element, the or each said slide being arranged to receive the, or a respective, said sliding element whereby to enable the secondary heat exchanger to be displaced in a straight line in sliding movement along the side wall of the water box up to an abutment position in which each said access orifices of the side wall is aligned with the corresponding seating.

2. Apparatus according to claim 1, having two said slides and two said sliding elements, each of the latter being arranged to be received in a corresponding one of the slides, the sliding elements being fixed with respect to the secondary heat exchanger.

3. Apparatus according to claim 2, wherein each said sliding element comprises a collar coaxial with the corresponding seating of the secondary heat exchanger.

4. Apparatus according to claim 3, wherein each said slide has a wall extending parallel to the side wall of the water box and separated from the latter by a distance slightly greater than the thickness of the collar, each collar having a first annular face and a second annular face opposed to the first annular face, the first annular face being arranged to come into abutment against the side wall of the water box and the second annular face being arranged to come into abutment against the wall of the slide.

5. Apparatus according to claim 4 in which the secondary heat exchanger comprises a body and a cylindrical portion joining each said collar to the said body of the secondary heat exchanger, each said cylindrical portion having a diameter which is smaller than that of the corresponding collar, wherein the wall of the slide has a slot defined by two parallel side edges facing each other, the slot being open at one end to enable the collar to be introduced into it and closed at its other end to define an abutment, whereby the two side edges of the slot define the direction of straight-line relative movement between the secondary heat exchanger and the water box, the two side edges of the slot being separated from each other by a distance which is substantially equal to the outer diameter of the cylindrical portion.

6. Apparatus according to claim 5, wherein the abutment at the closed end of the slot is defined by a semi-circular edge joining the two parallel side edges of the slot together, the radius of the semi-circular edge being substantially equal to the radius of the cylindrical portion and struck from a centre aligned with the centre of an access orifice.

7. Apparatus according to claim 5 in which the water box has an open side, wherein the open end of the slot is orientated towards the open side of the water box.

8. Apparatus according to any one of claims 4 to 7, wherein the water box has a base wall, the wall of each slide having parallel connecting edges joining it to the side wall of the water box, the slides also being joined to the base wall of the water box.

9. Apparatus according to claim 1, wherein the water box is of moulded plastics material, with the or each slide being formed integrally with it.

* * * * *